US005329652A

United States Patent [19]

Wiedeck et al.

[11] Patent Number: 5,329,652

[45] Date of Patent: Jul. 19, 1994

[54] DEPLOYABLE BRIDGE AND VEHICLE FOR LAYING THE BRIDGE

[75] Inventors: Hans-Norbert Wiedeck, Mülheim; Wolfgang Diefendahl, Straelen, both of Fed. Rep. of Germany

[73] Assignee: Krupp Industrietechnik Gesellschaft mit beschränkter Haftung, Duisburg, Fed. Rep. of Germany

[21] Appl. No.: 41,211

[22] Filed: Mar. 31, 1993

[30] Foreign Application Priority Data

Mar. 31, 1992 [DE] Fed. Rep. of Germany ..... 92105517

[51] Int. Cl.[5] ..... E01D 15/12

[52] U.S. Cl. ..... 14/5; 14/2.5

[58] Field of Search ..... 14/2.4, 2.5, 2.6, 5

[56] References Cited

U.S. PATENT DOCUMENTS

| | | | |
|---|---|---|---|
| 4,143,439 | 3/1979 | Fitzgerald-Smith et al. | 14/10 |
| 4,602,399 | 7/1986 | Jenkins | 14/2.4 |
| 5,042,101 | 8/1991 | Huether | 14/2.4 |
| 5,117,525 | 6/1992 | Kärcher | 14/2.5 |

FOREIGN PATENT DOCUMENTS

| | | |
|---|---|---|
| 1207948 | 12/1965 | Fed. Rep. of Germany . |
| 2116120 | 10/1972 | Fed. Rep. of Germany . |
| 2324646 | 12/1974 | Fed. Rep. of Germany . |
| 2807859 | 8/1978 | Fed. Rep. of Germany . |
| 3814502 | 11/1989 | Fed. Rep. of Germany . |

*Primary Examiner*—Ramon S. Britts
*Assistant Examiner*—Pamela A. O'Connor
*Attorney, Agent, or Firm*—Spencer, Frank & Schneider

[57] ABSTRACT

A deployable bridge includes a plurality of identical bridge sections each having two identical track elements. Each track element has a roadway carrier, a bottom boom and adjustment elements connecting the bottom boom with the roadway carrier. The bottom boom of each track element includes a mid section and two end sections flanking the mid section. Each track element further comprises pillars having opposite first and second ends. The first end of the pillars is articulated to the mid section of the bottom boom. Each track element also has a drive shaft assembly suspended from the track element; spindle sleeves inserted on the drive shaft assembly; and a spindle head threadedly mounted on each spindle sleeve. The pillars are articulated by the second end thereof to a respective spindle head. There are further provided coupling elements attached to opposite ends of the drive shaft assembly; and separate connecting elements for torque-transmittingly connecting the spindle sleeves with the drive shaft assembly.

12 Claims, 12 Drawing Sheets 2
27
26
73
3
6
73
5
23,37
56
4
3
21,35

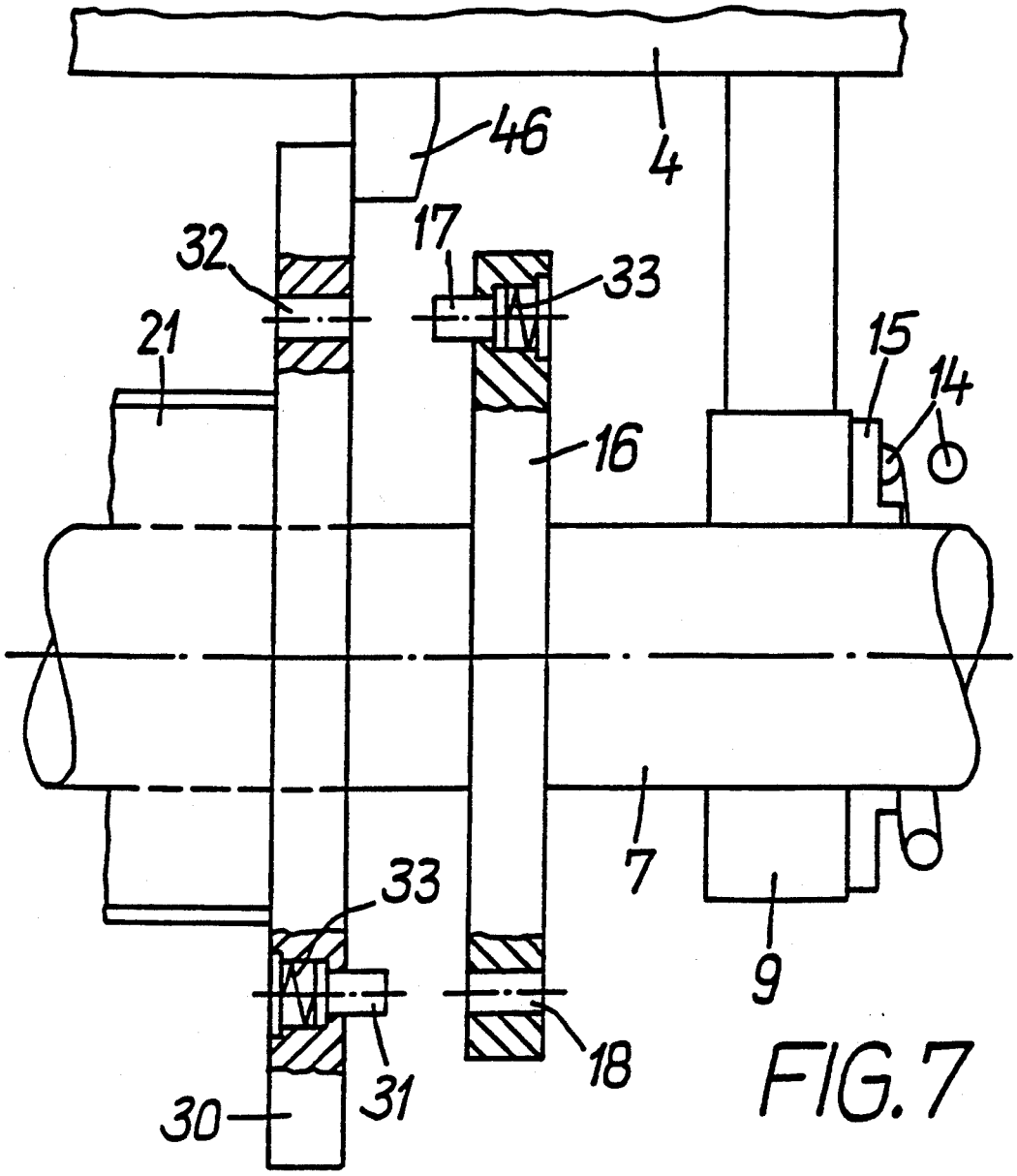
FIG. 7
FIG. 8
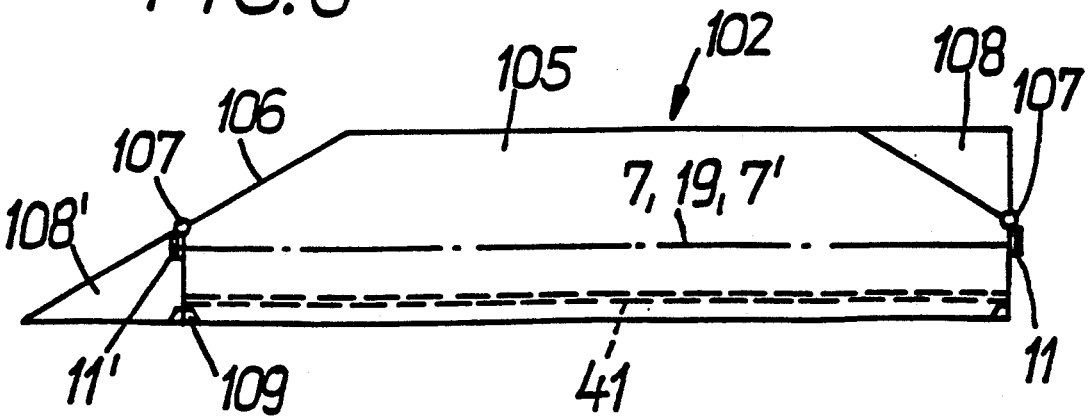

DEPLOYABLE BRIDGE AND VEHICLE FOR LAYING THE BRIDGE

CROSS REFERENCE TO RELATED APPLICATION

This application claims the priority of European Application No. 92 105 517.4 filed Mar. 31, 1992, which is incorporated herein by reference.

BACKGROUND OF THE INVENTION

This invention relates to a deployable bridge composed of a plurality of identical bridge sections each having two identical lateral track elements and each being provided with a roadway carrier and a bottom boom (chord) that is connected with the roadway carrier by means of adjustment elements. The bottom boom is adjustable in height with respect to the roadway carrier and constitutes a bottom tensioning assembly. The track elements of each bridge section are connected with one another by transverse supports and the roadway carriers and the bottom booms of bridge sections that are arranged one behind the other can be coupled together. The invention also relates to a vehicle equipped with a telescoping carrier for laying the bridge.

Deployable bridges are employed for allowing vehicles weighing up to about 70 tons to traverse obstacles such as bodies of water, depressions in the terrain and the like. While the majority of the obstacles lie in a range of about 14 m, the vehicles should also be able to traverse obstacles of 40 to 45 m. It is known to assemble for this purpose deployable bridges from a different number of bridge sections depending on the desired bridge length. It is of advantage to selectively use identical bridge sections as end or ramp sections or as center or intermediate sections.

A bridge of the above-outlined type is disclosed in German Offenlegungsschrift 38 14 502 to which corresponds U.S. Pat. No. 5,042,101. The bottom booms of the bridge elements disclosed therein are arranged in a straight line one behind the other and the roadway carriers constituting the track form an upwardly oriented polygon. Since the roadway carriers have a uniform length, the bottom booms and the cross-struts that connect the bottom booms with the roadway carriers must be varied in length depending on the position of the bridge element within the bridge before they can be finally locked and coupled together. Such an arrangement, however, has the drawback that a considerable amount of time is required for the installation of the entire bridge. Moreover, this known bridge has the drawback that its structural height is considerable if the bridge is long so that the vehicles must traverse a "mountain" which greatly reduces the crossing performance.

German Offenlegungsschrift 28 07 859 discloses a bridge that is composed of individual elements. In this structure, however, non-identical bridge elements (ramp sections and center or intermediate units) are provided and a separate bottom tensioning assembly with a reinforcing chain and mechanically adjustable pillars are used. The unlike elements (ramps and end sections as well as intermediate and middle sections) involve increased transporting expenses compared to identical bridge elements. Moreover, the number of bridges that can be built from these bridge elements is limited to the number of available ramp sections.

German Patent 1,207,948 discloses a deployable bridge composed of sections (ramp sections and center sections) each having two pairs of juxtaposed bridge elements. Each bridge element includes a roadway carrier forming the track and a bottom boom, all connected with the roadway carrier by pillars that are disposed at the beginning and at the end of the bridge elements. The pillars which are subjected to pressure have a joint in the center to render them collapsible and the bottom boom can be folded against the roadway carriers. This results in a lower transporting height for the bridge elements as compared to the height of the finished bridge structure. The corner points of the bridge carriers are provided with diagonally arranged tension elements which impart additional stability to the bridge carrier and to the bridge section. The assembly of the bridge is performed individually for each bridge element which involves a considerable installation time. The bridge sections for the ramps and the major portion of the bridge are unlike structures.

SUMMARY OF THE INVENTION

It is an object of the invention to provide an improved deployable bridge of the above-mentioned type, that is, a bridge having identical bridge sections, so that an essentially planar roadway is produced for the entire bridge and the bridge can be installed in a short time, and wherein the bridge sections have a low transporting height and the bridge is suitable for high loads and large spans.

This object and others to become apparent as the specification progresses, are accomplished by the invention, according to which, briefly stated, the deployable bridge includes a plurality of identical bridge sections each having two identical track elements. Each track element has a roadway carrier, a bottom boom and adjustment elements connecting the bottom boom with the roadway carrier. The bottom boom of each track element includes a mid section and two end sections flanking the mid section. Each track element further comprises pillars having opposite first and second ends. The first end of the pillars is articulated to the mid section of the bottom boom. Each track element also has a drive shaft assembly suspended from the track element; spindle sleeves inserted on the drive shaft assembly; and a spindle head threadedly mounted on each spindle sleeve. The pillars are articulated by the second end thereof to a respective spindle head. There are further provided coupling elements attached to opposite ends of the drive shaft assembly; and separate connecting elements for torque-transmittingly connecting the spindle sleeves with the drive shaft assembly.

Due to the independent coupling of the spindle sleeves with the drive shaft arrangement and the sectional structure of the bottom boom, the extended bottom boom can be a continuous (throughgoing) member for a center or intermediate section or a unilateral member for a ramp or end section. The drive shaft arrangement can be connected by coupling elements provided at its ends with the drive shaft arrangements of the remaining bridge sections to form a continuous drive shaft which passes through the bridge (composed of a plurality of bridge sections) and which is unitary with respect to torque transmission. By rotating the entire drive shaft arrangement from a single location, all bottom booms of one side of the roadway or of one track can be extended jointly and simultaneously. Once the bottom boom is retracted, the bridge sections have a low transporting height while a fully extended bottom boom gives the bridge sections great bending strength.

According to a further feature of the invention, an independent coupling of the spindle sleeves and thus an alternative configuration of a ramp or end section or a central or intermediate section can be obtained by forming the drive shaft arrangement of each track element from two axially mutually displaceable drive shafts that are connected with one another by means of a connecting element preventing relative rotation and twisting. The length of these drive shafts is only about one half the length of a bridge section. In an individual bridge section, both drive shafts are, by spring force, pushed a certain distance out of the bridge section or the track element. In case the respective bridge section is coupled to a further bridge section, the facing drive shafts of the two bridge sections or track elements, as the case may be, are pushed in and, by coupling only the closest spindle sleeve, two ramp sections are formed automatically in which only one end of the bottom booms is extended. If, on the other hand, at least three bridge sections are coupled together, both drive shafts are pushed inwardly in the central or intermediate sections so that all spindle sleeves of this section or these sections are coupled with the drive shaft arrangement, and the bottom boom of this section or the booms of these sections are correspondingly extended downwardly to their full length.

In order to ensure an unequivocal and secure tensioning of the bottom booms, according to a further feature of the invention the couplings are form-locking. In the bridge sections according to the invention, the coupling conditions are thus unequivocal and require no verification by limit switches or the like.

To increase the stability of the entire bridge, according to still another feature of the invention the track elements are provided, between the roadway carriers and the ends of the bottom boom sections articulated to the pillars, with diagonally extending, tension-loadable reinforcing elements.

To ensure that the ramp sections can rest on the shore over a relatively large portion of their length when the bottom boom is extended, according to a further feature of the invention the center section of the bottom boom is divided into two sub-sections by means of a joint, and a lock prevents the center sections from bending downwardly.

To ensure that the identical bridge sections are usable as end sections and as center sections for the bridge even for larger structural heights, the bridge elements are provided with deployable ramp sections.

For laying a bridge structured according to the invention, the invention also provides a vehicle which includes a telescoping carrier as disclosed in German Offenlegungsschrift 21 16 120.

The vehicle should be suitable to rapidly and reliably grip and drive the drive shaft arrangement which is provided in the bridge sections coupled together to form a bridge and which serves to actuate the bottom boom sections. The vehicle has a rotary drive to be coupled to the respective facing end of the drive shaft arrangement of the bridge to be deployed. The rotary drive is disposed at a pivot arm that is articulated to the cantilever arm. A main pivot cylinder is provided for the pivot arm and the position of the pivot axis of the pivot arm can be varied by at least one further hydraulic cylinder. A centering device is provided; at least one part of the centering device is connected with the rotary drive and one part is connected with the bridge to be deployed. By means of the pivot arm driven by the main pivot cylinder it is possible to approximately center the rotary drive with the drive shaft arrangement of the bridge. Fine centering may be accomplished by means of the centering device and the additional hydraulic cylinder as well as by the variable position of the pivot axis of the pivot arm. Deviations in position that might be caused by play of the rollers and manufacturing inaccuracies can be compensated over a limited range in the horizontal as well as the vertical direction.

Preferably, the pivot arm is pivotal in the lower region of the cantilever arm about an axis extending parallel to the longitudinal axis of the vehicle. With this type of articulation, the pivot arm, when in the transporting position, may be disposed closely below the bridge or the bridge sections. In this position, the pivot arm does not interfere with a movement of the bridge. Moreover, this position has the advantage that the pivot arm need perform only a short angular pivoting movement until it reaches the operating or coupling position.

In a preferred embodiment, the centering device is provided with conically shaped mechanical components. These components are robust and reliable in operation.

In addition, the centering device may advantageously include a transmitter that emits a measuring beam suitable for performing distance measurements and a conical counter-member.

The rotary drive is preferably as a hydrostatic motor.

BRIEF DESCRIPTION OF THE DRAWINGS

FIG. 7 is an enlarged sectional side elevational view of another detail of the drive arrangement.

FIG. 8 is a side elevational view of another preferred embodiment of a bridge section.

DESCRIPTION OF THE PREFERRED EMBODIMENTS

Figure 1:
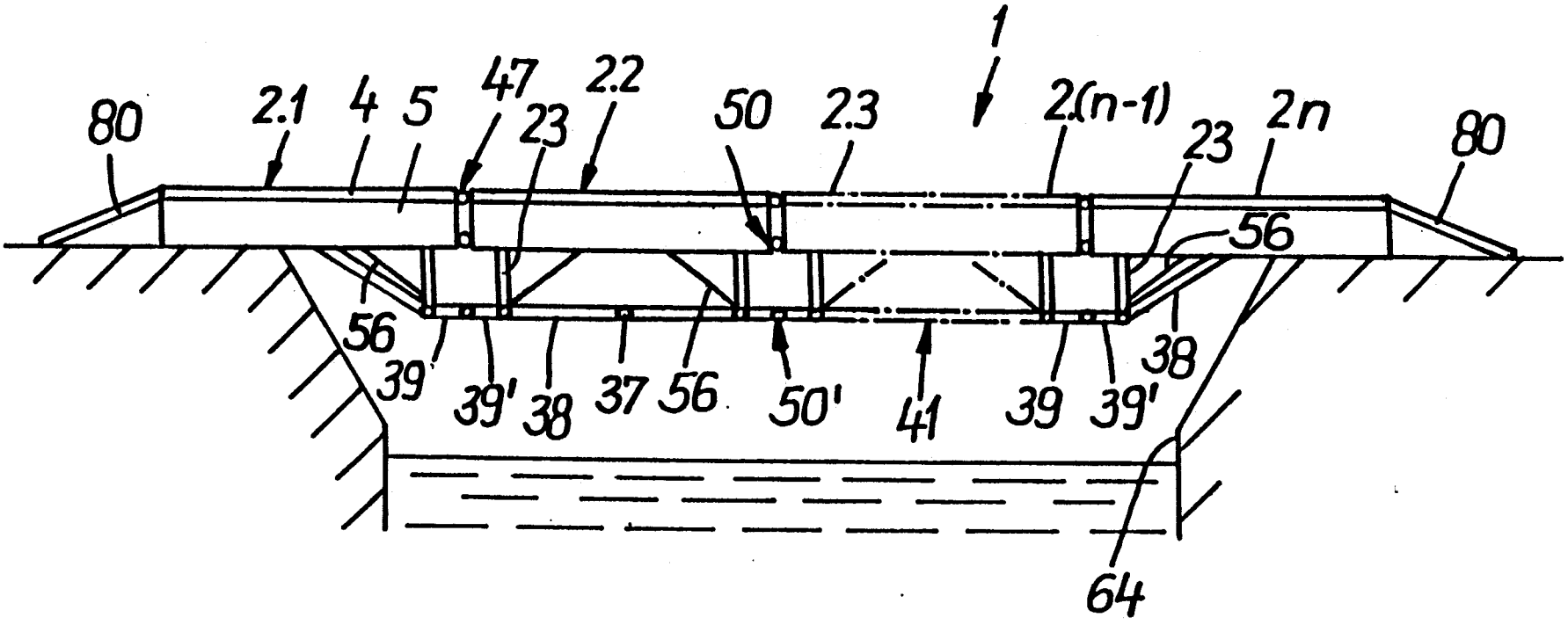
FIG. 1 is a side elevational view of a bridge according to a preferred embodiment of the invention, deployed across an obstacle.
Figure 2:
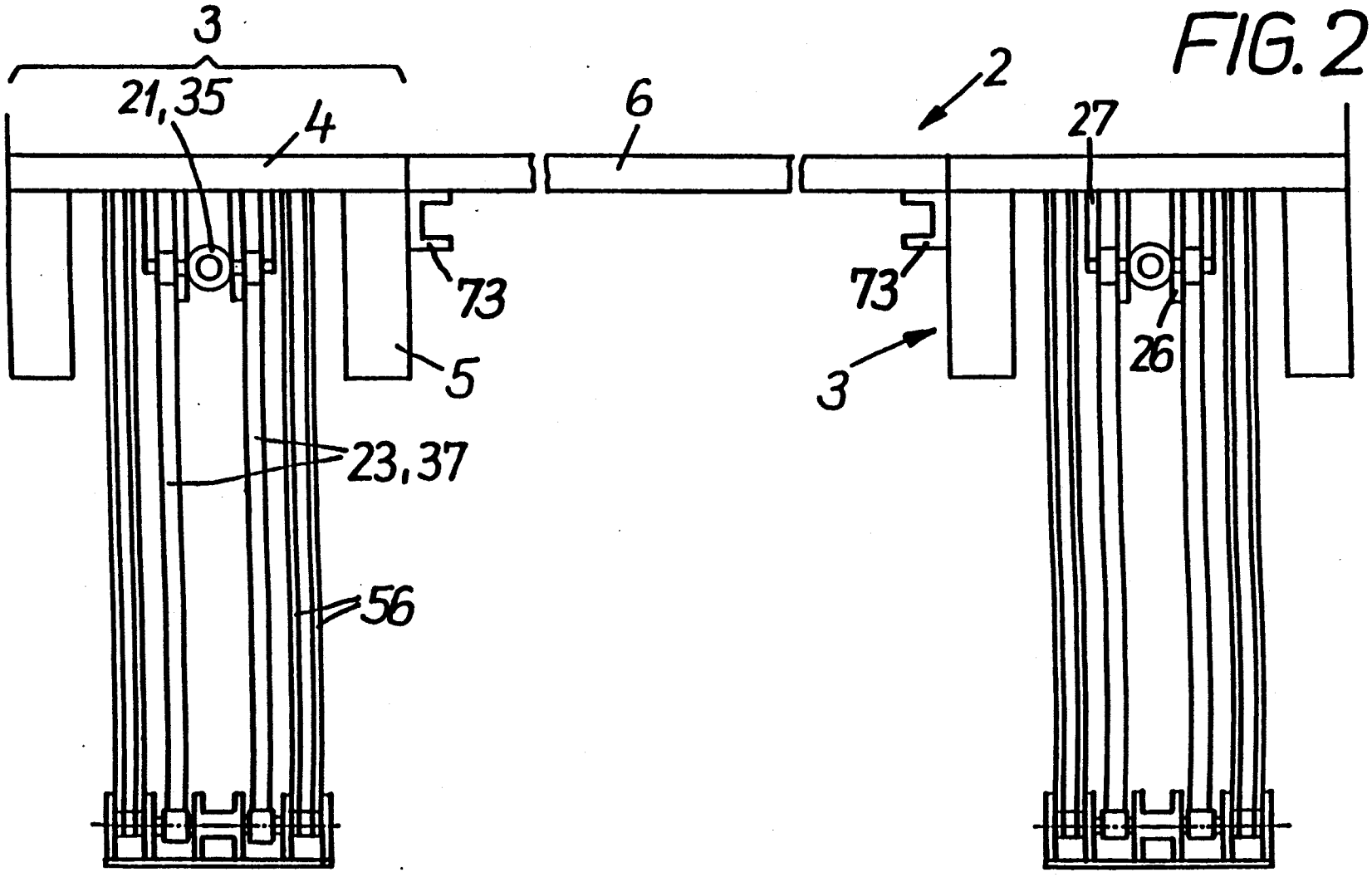
FIG. 2 is a simplified sectional end elevational view of the bridge.

Turning to FIGS. 1 and 2, the deployable bridge 1 is composed of several identically structured bridge sections designated at 2.1, 2.2, . . . , 2.n in FIG. 1 and designated at 2 in FIG. 2. Each bridge section 2 is composed of a pair of identically structured, parallel arranged track elements 3, each including a roadway carrier 4 which forms a track and which is provided with two lateral box-shaped reinforcements 5. The two track elements 3 of each bridge section 2 are rigidly connected with one another at the level of the roadway carriers 4 by several transverse supports 6.

Figure 3:
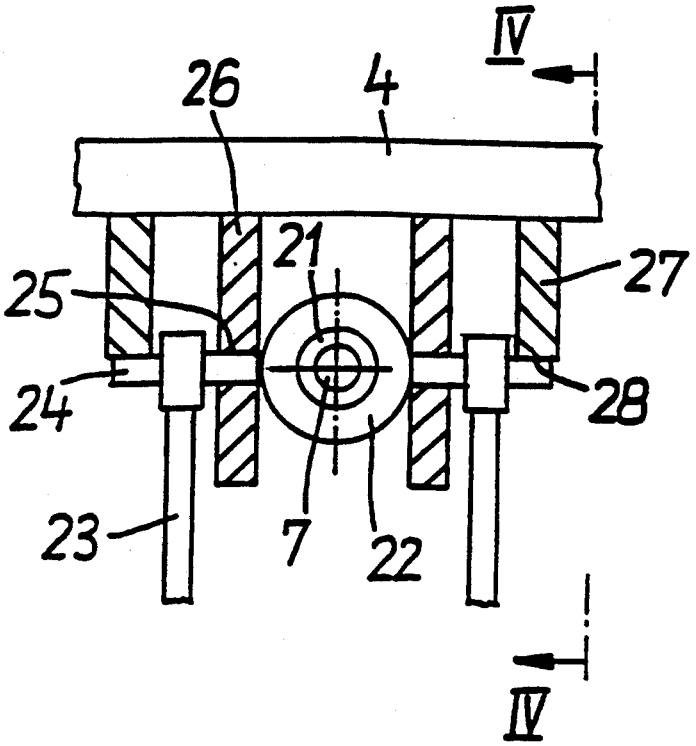
FIG. 3 is an enlarged end elevational view of a detail of the bridge.
Figure 5:
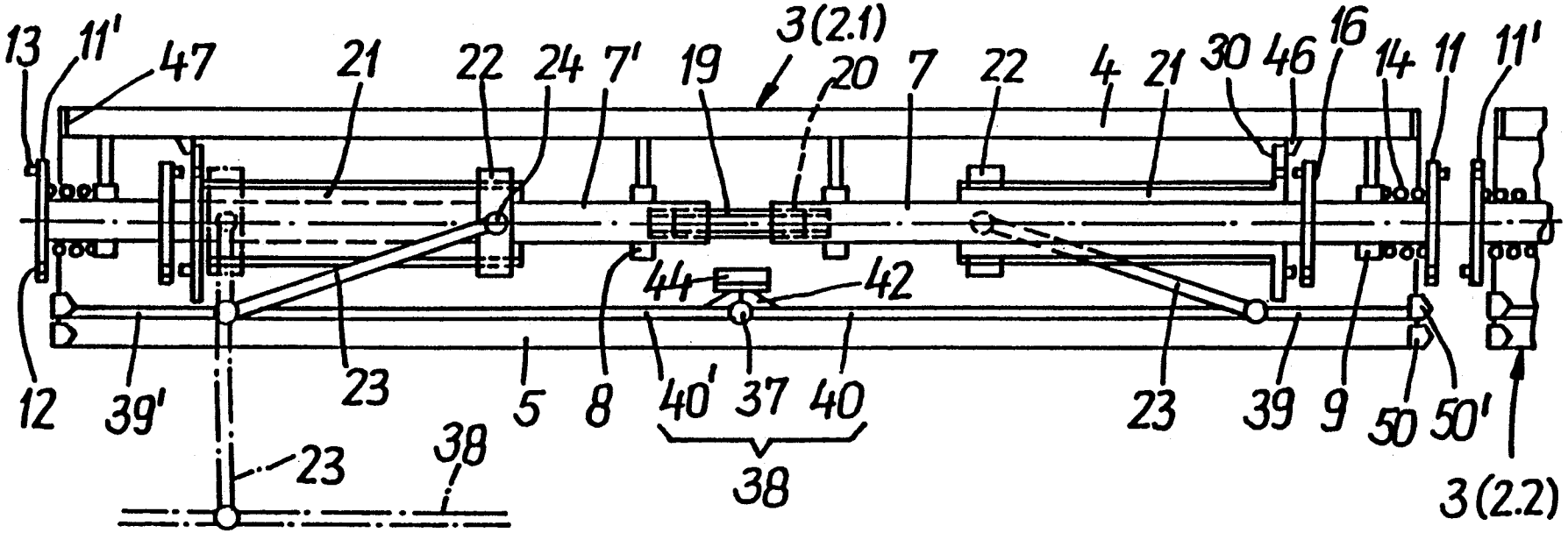
FIG. 5 is a sectional side elevational view of a bridge element in the transporting position.

Also referring to FIGS. 3, 5 and 7, two drive shafts 7 and 7' are supported in each track element 3 in bearings 8 and 9 suspended from the roadway carrier 4. The respective outer ends of drive shafts 7 and 7' are provided with a coupling flange 11 and 11', respectively, which is alternatingly provided with recesses 12 and corresponding coupling pins 13 that face away from shafts 7 and 7', respectively. When two bridge sections 2 (for example, bridge sections 2.2 and 2.1) are coupled together, axial pressure causes the pins 13 of flanges 11 and 11' to enter into the recesses 12 of the respective other flange. In order to prevent damage to the coupling pins 13 during the axial coupling even if they are not in alignment with recesses 12 at the beginning of the coupling process, the coupling pins 13 are supported by springs, as will be described below.

As an alternative, flanges 11 and 11' may also be provided with crown gearing or with a planar wedge profile.

In each bridge section 2, a compression spring 14 is disposed between the respective outer coupling flange 11, 11' and the adjacent bearing 9 to urge the drive shafts 7 and 7' beyond the end of bridge elements 3. Each compression spring 14 is supported by a slide ring 15 against the respective bearing 9 and engages the respective flange 11, 11'.

On that side of the bearing 9 which faces away from flange 11, 11', the drive shafts 7 and 7' are provided with a further, interior flange 16 which is alternatingly provided with coupling pins 17 that are oriented toward the center of track element 3 and with corresponding recesses 18.

The inner ends of the drive shafts 7 and 7' are spaced from one another in the middle of track elements 3. The inner ends of the drive shafts 7 and 7' are provided with a spline, by means of which they are in a rigid torque-transmitting, but longitudinally (axially) slidable coupling with a connecting element 19 having the profile of a spline shaft at its ends associated with the drive shafts 7 and 7'. Thus, the drive shafts 7 and 7' form a variable-length drive shaft arrangement (7, 19, 7') that is continuous with respect to torque transmission.

Figure 4:
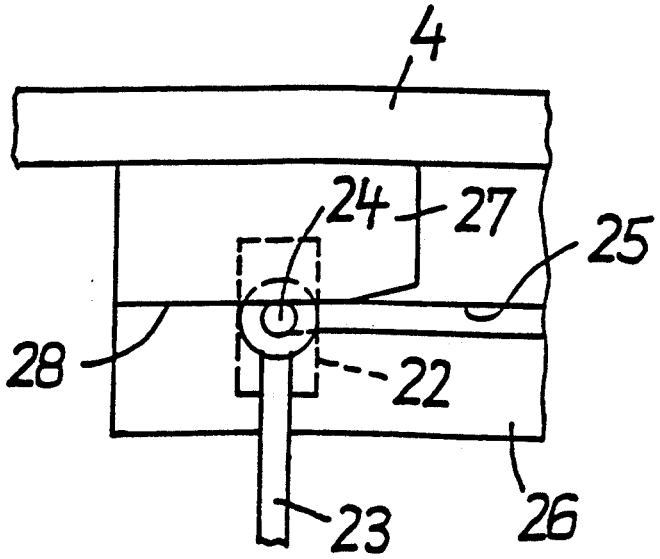
FIG. 4 is a partially sectional view taken along line IV—IV of FIG. 3.

Adjacent opposite ends of the track element 3, spindle sleeves 21 are mounted coaxially on the drive shafts 7 and 7'. The spindle sleeves have no torque-transmitting connection with the drive shafts 7, 7' and are axially displaceable relative thereto. A spindle head 22 having an internal thread is mounted on each spindle sleeve 21 and engages external threads thereof. Two pressure resistant pillars 23 are articulated to pins 24 at the exterior faces of spindle head 22. With particular reference to FIGS. 3 and 4, pins 24 slide in guides (guide grooves) 25 that extend parallel to roadway carriers 4 in metal plates 26 arranged perpendicularly to the roadway carriers 4. The weight of the spindle heads 22 of pillars 23 and the components suspended therefrom is absorbed by the guides 25 and thus loads from drive shafts 7 and 7' and their bearings 8 and 9 are removed.

In the zone of the spindle stroke, where the pillars 23 are oriented essentially perpendicularly downward, further metal plates 27 are arranged between metal plates 26 and reinforcements 5. The plates 27 are provided with a lower slide or pressure face 28 which essentially has the same height as the upper slide face of the guide groove 25. The pressure forces introduced into the pillars 23 when the tensioning assembly is extended are thus able to be supported directly by the pins 24 of spindle heads 22 against the metal plates 26 and 27 and can be isolated from the threaded components 21, 22 and the shafts 7, 7'.

At their ends oriented toward the longitudinal ends of the track elements 3, the spindle sleeves 21 are provided with a coupling flange 30 which has alternating coupling pins 31 oriented toward the respective end of the track element 3 and recesses 32 to cooperate with respective recesses 18 and pins 17 of the flanges 16.

If a drive shaft (for example, the drive shaft 7) is pushed into the track element 3 when the two bridge sections (2.2, 2.1) are being coupled together, the engagement of the pins 17 and 31 in the recesses 32 and 18, respectively, of the respective other flange 30 and 16, results in a coupling process between the drive shaft 7 and the spindle sleeve 21 so that the latter is connected with the drive shaft arrangement 7, 19, 7' in a manner that is resistant to torsion. The two spindle sleeves 21 of each track element 3 are threaded with oppositely oriented pitches.

To ensure that the pins 17 and 31 engage in the associated recesses 32 and 18 reliably and without risks of damage, the pins 17 and 31 are each pre-tensioned by a spring 33. The same spring mount is provided for the coupling pins 13 of the coupling flanges 11 and 11'.

Between the two pillar pairs 23 of each track element 3 a bottom boom section 38 is articulated which is provided with a middle joint 37. Further bottom boom end sections 39 and 39' respectively, are articulated to the respective outer ends of the section 38; each section 39, 39' extends to a longitudinal end of the track element 3. The joint 37 subdivides the bottom boom section 38 into two sub-sections 40 and 40'. The bottom boom sections 38, 39 and 39' together form the overall bottom boom designated at 41 of the respective track element 3 in FIG. 1.

Figure 6:
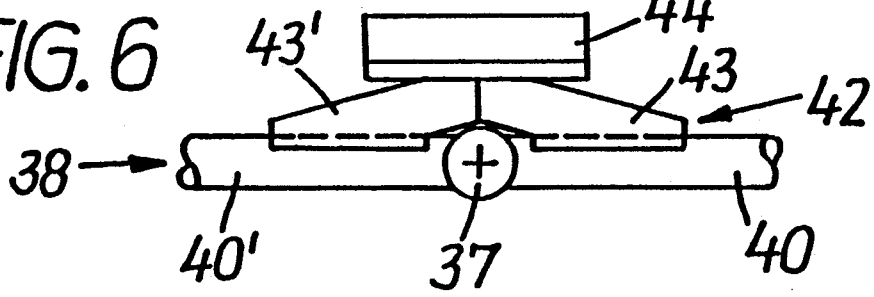
FIG. 6 is an enlarged sectional side elevational view of a detail of the bridge element of FIG. 5.

With reference to FIG. 6, to prevent the bottom boom section 38 from pivoting downwardly, the joint 37 is provided 20 with a lock 42 that limits the pivoting movement of sub-sections 40 and 40'. The lock 42 is composed of a stop 43 and 43', fastened to the bottom boom sections 40 and 40', respectively. If sub-sections 40 and 40' are in the extended position, the stops 43, 43' abut against one another. Also referring to FIG. 5, to maintain the position of the bottom boom section 38 stable in the upper transporting position, a fixed stop 44 is additionally provided in the track element 3 underneath the roadway carrier 4 between the reinforcements 5.

At the height of the roadway carriers 4, the track elements 3 are provided with coupling stops 47 that can be exposed to pressure and at the bottom end of the reinforcements 5 couplings 50 are provided that can be tensioned.

Figure 9:
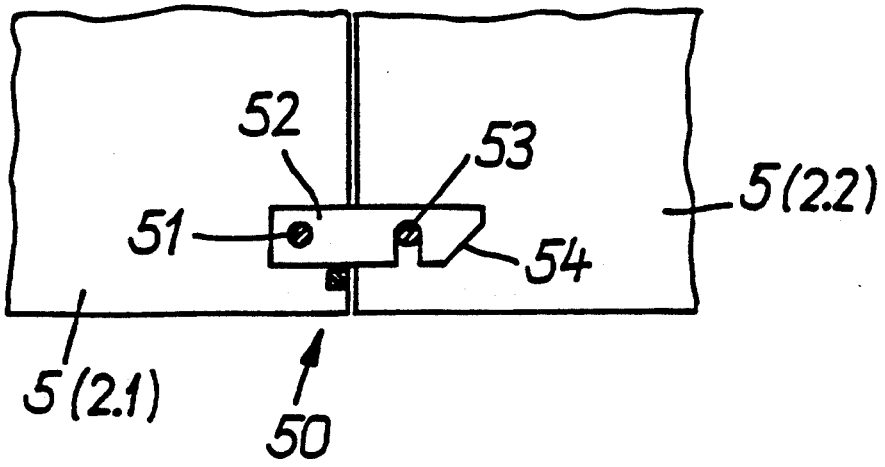
FIG. 9 is a side elevational view of a lower coupling of the roadway carrier of the bridge.

Also referring to FIG. 9, at two diagonally opposite corners of a bridge section 2 (2.1, 2.2) within reinforcements 5, the couplings 50 include one or a plurality of juxtaposed hooks 52 that can be turned upwardly about a pivot 51 and a cooperating pin 53 situated at each of the respective other corners of the bridge section. The hooks 52 have a slope 54 by means of which they slide over the associated pins 53 of the respective other bridge section when two bridge sections 2 are pushed together. The hooks 52 and the pins 53 establish a tension-resistant coupling between the bridge sections.

Figure 10:
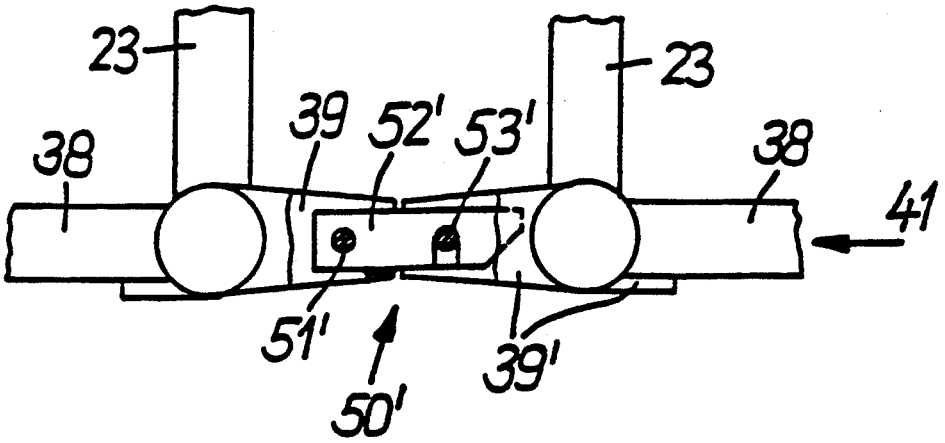
FIG. 10 is a side elevational detail view of a coupling between two bottom booms.

Bottom booms 41 are provided with tension-loaded couplings 50' which are comparable to couplings 50. As shown in FIG. 10, the sections 39 and 39' articulated to the exterior of center bottom sections 38 are each provided with one or a plurality of juxtaposed hooks 52' which can be pivoted upwardly about a pivot 51' and which cooperate with a respective pin 53'.

If a bridge section, for example section 2.2, is combined with another bridge sections, for example section 2.1, with their respective bottom booms 41 (formed of parts 38, 39, 39') still retracted, the drive shafts 7 and 7' of the facing ends of the bridge sections are coupled together by way of the outer coupling flanges 11 and 11' that project from the end faces of the roadway elements 3 and are pushed by axial pressure so far into the roadway elements 3 that the spindle sleeves 21 are brought into torque-transmitting engagement with the respective drive shaft 7 or 7' by means of their coupling flange 30 and the inner coupling flange 16 of the respective drive shaft. Moreover, couplings 50 and 50' are coupled and stops 47 lie firmly against one another.

To prevent the bottom boom 41 from escaping to the side and thus avoid coupling if a bridge section (2.1) is coupled with only one further bridge section (2.2), a stop 46 is provided for the coupling discs 30 of the spindle sleeves 21 at the underside of each roadway 4, as shown in FIGS. 5 and 7. Although with such one-sided coupling of two bridge sections (2.1, 2.2) the drive shaft arrangements 7, 19, 7' of both bridge sections (2.1, 2.2) are fully coupled together, only the spindle sleeves 21 facing the coupling location are coupled by flanges 16 and 30 with drive shaft arrangements 7, 19, and 7'. At the two opposite, free ends of the bridge sections (2.1, 2.2) the coupling discs 11, 11' and the coupling discs 16 are not inserted due to the absence of axial pressure so that the spindle sleeves 21 remain uncoupled at these ends. The associated stops 46 prevent inadvertent coupling of the flanges 30 of these spindle sleeves 21.

Upon rotation of the drive shaft arrangement (7, 19, 7'), the two mutually facing spindle sleeves 21 of the two bridge sections (2.1, 2.2) likewise rotate and the associated spindle heads 22 move in the direction toward the corresponding longitudinal ends of the roadway elements 3. During and due to this occurrence, the pillars 23 push the respective articulated bottom section 40 or 40' downward, away from roadway carrier 4. Due to the geometrical "compatibility" that is the given fixed lengths of the individual components, the respective other bottom section 40' or 40 of the respective bottom boom section 38 is "pulled along" horizontally. This is possible, because the other spindle sleeve 21 of the respective track element 3 is axially displaceably mounted on the drive shaft arrangement (7, 19, 7').

If three (or more) bridge sections 2 (2.1, . . . 2.n) are coupled together (see FIG. 1, middle), both drive shafts 7 and 7' of the center bridge section(s) are pushed inwardly so that both spindle sleeves 21 of the respective track elements 3 are coupled with the drive shaft arrangement 7, 19, 7'. Upon rotation of the drive shaft arrangement (7, 19, 7') both spindle sleeves 21 rotate simultaneously so that the facing and associated spindle heads 22 move away from one another, and the bottom boom section 38 as well as the entire bottom boom 41 together with the end sections 39 and 39' are uniformly pushed downward parallel to themselves, that is, away from the roadway carrier 4.

In order to increase stability of the individual bridge sections 2 and thus of the entire bridge when the bottom boom 41 is in an extended state, flexible, tension-loaded elements 56 are articulated to the roadway carrier 4. Each element 56 is jointed at its other end to an end of the center bottom boom section 38. The rotary movement of the drive shaft arrangement (7, 19, 7') continues until the elements 56 are tensioned. In the extended state of the bottom boom 41, the tension elements 56 are oriented obliquely or diagonally.

In practice, a sufficient number of bridge sections 2 are pre-assembled to result in a total bridge length that will sufficiently span the obstacle 64. In the simplest case, an installation beam may be placed across the obstacle for this purpose. Then, one bridge section 2 after the other is placed on the installation beam while the bottom booms 41 are in a withdrawn state. The bridge sections 2 are supported on the installation beam by the transverse supports 6. As a bridge section 2 is placed on the installation beam, it is coupled with the previously positioned bridge section or sections and pushed along the beam in sections in the direction of the other shore of obstacle 64. Once the bridge 1 has reached its full length, at a selected location of the shaft string composed of the individual drive shaft arrangements 7, 19, 7' of all the bridge sections 2 a torque is applied to one of the coupling flanges 11 on each bridge section side, and the bottom booms 41 of all bridge sections 2 are simultaneously extended downwardly. For the end sections that rest on the shore, this applies, however, only to the ends of the bottom boom section 38 that face the coupling. When the bottom booms 41 of both bridge or track sides have been extended, the bridge has reached its full load carrying capability and the installation beam can be retracted.

Figure 11:
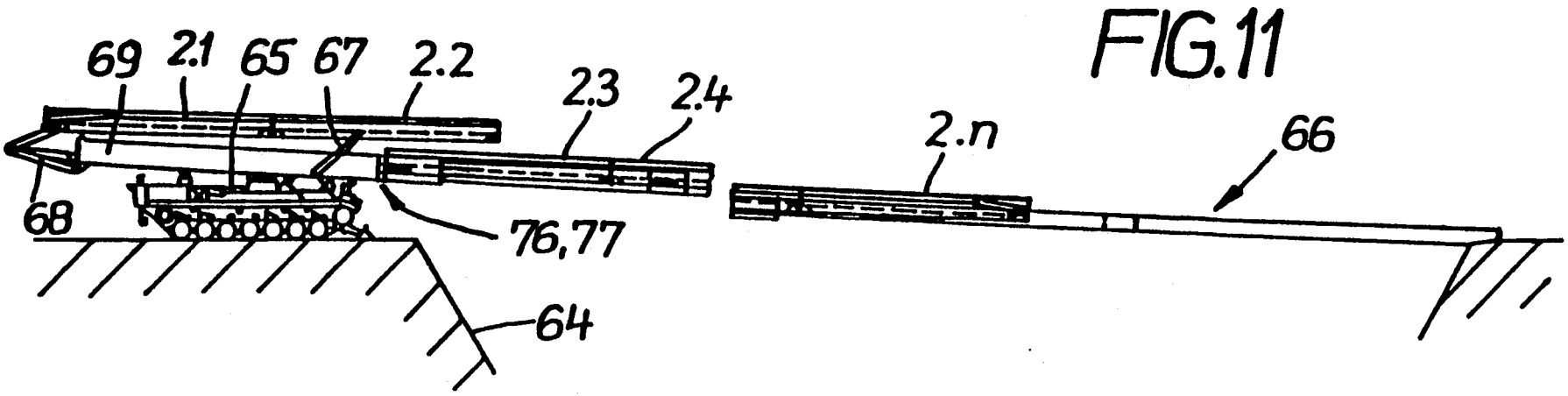
FIG. 11 is a schematic side elevational view of a bridge laying vehicle while laying the bridge across an obstacle.
Figure 12:
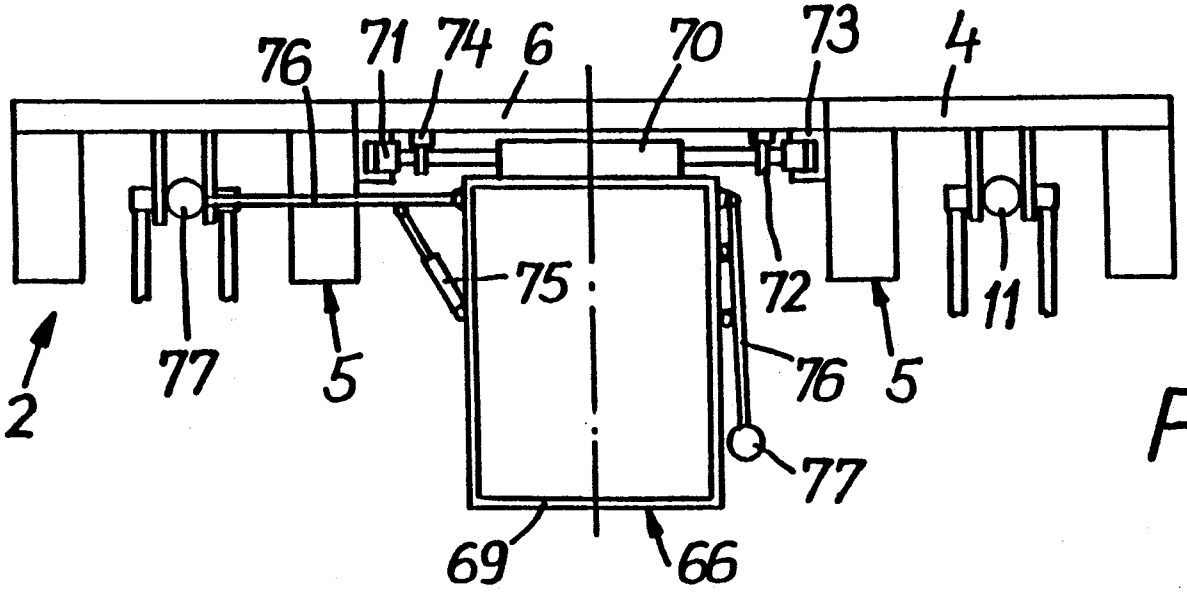
FIG. 12 is a simplified sectional end elevational view of a cantilever carrier of the laying vehicle and a bridge section.
Figure 13:
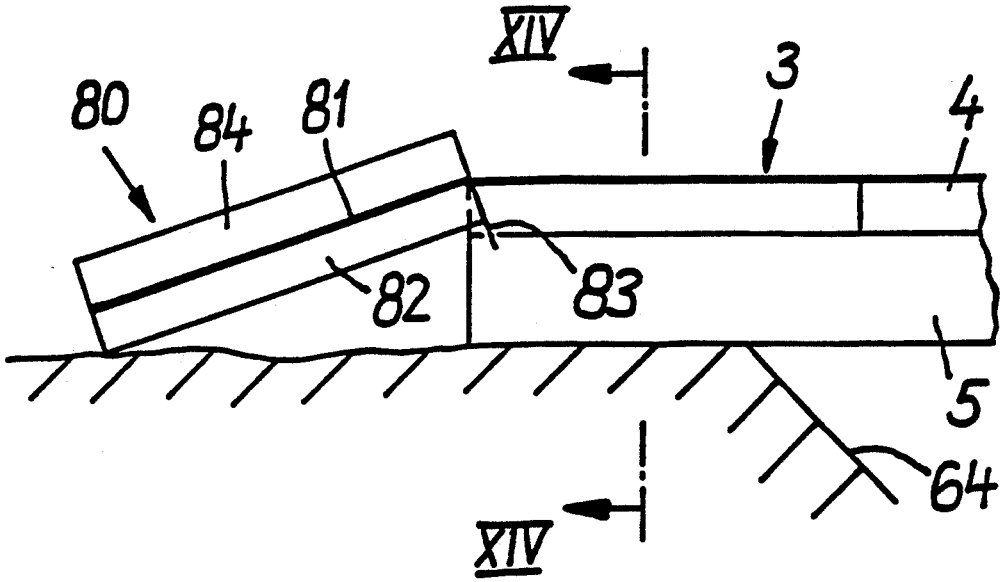
FIG. 13 is a sectional side elevational view of an end of a bridge element with a ramp portion extended.
Figure 14:
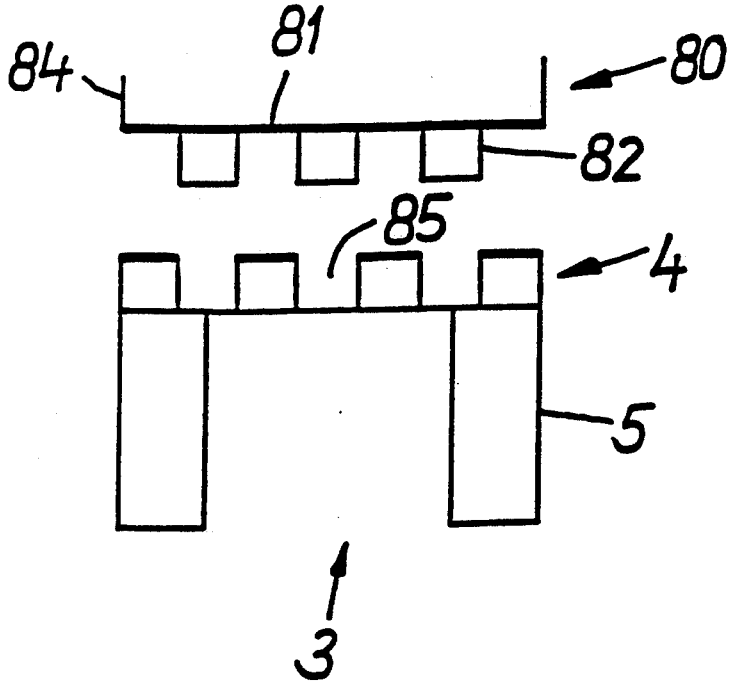
FIG. 14 is a sectional end elevational view of the bridge element and the ramp section taken along line XIV—XIV of FIG. 13; for the sake of clarity, the ramp section is shown raised relative to the retracted position.

Turning to FIGS. 11 and 12, for a rapid and automatic laying of the deployable bridge 1, according to the invention, a laying vehicle 65 is used that is equipped with a telescoping cantilever carrier 66. Such a carrier is disclosed, for example, in German Offenlegungsschrift 21 16 120. During transport, two bridge sections 2.1, 2.2 lie on the still retracted carrier 66, and two further "layers" of pairs of coupled-together bridge sections 2.3, 2.4 are carried by two pairs of arms 67 and 68 which are articulated to the laying vehicle 65 and which are provided with an integrated lift-off protector. The basic body 69 of the carrier 66 and the pair of arms 68 each are provided with a drive 70 for advancing the bridge sections 2. The drive 70 is situated at the top of the basic body 69 of the cantilever carrier 66. The drive 70 includes a shaft whose ends carry a roller 71 and a toothed wheel (gear) 72. The rollers 71 engage in U-shaped rails 73 which are disposed underneath the transverse beams 6 between the internal reinforcements 5 and extend in the longitudinal direction of the bridge sections 2. The remaining telescoping sections or bodies of the cantilever carrier 66 also carry rollers 71 to guide the bridge sections 2. Gears 72 engage in toothed rods 74 fastened to the bridge section. By means of this arrangement a positive feed may be achieved.

A pivot arm 76 is articulated to each side of the basic body 69 and is movable by a respective hydraulic cylinder 75. At its free end, each pivot arm 76 is provided with a preferably hydrostatic rotary drive 77. Each rotary drive 77 is provided with a coupling flange (not shown separately) which fully corresponds to the coupling flanges 11 of the drive shafts 7 and 7'. After the bridge sections 2 required for a certain length have been coupled together to form a bridge, the bridge is pushed forward on the telescoping carrier 66 by the drive 70 until the pivotal rotary drives 77, together with their coupling flanges, may be pivoted upwardly in front of the coupling flange 11 of the bridge 1. Thereafter, that is, before extending the bottom boom sections, the bridge is retracted to such an extent that the rotary drives 77 enter into engagement with the coupling flanges 11, but the coupling flanges 16 and 30 at the ends of the bridge section directly facing the rotary drive 77 do not engage.

Figure 15:
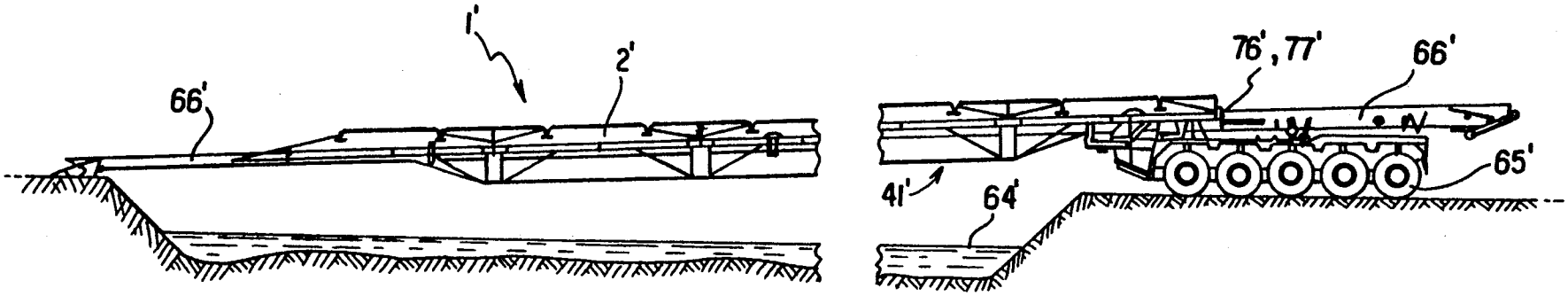
FIG. 15 is a side elevational view of a laying vehicle in the form of a wheeled vehicle with extended bottom booms during the laying of a bridge.
Figure 16:
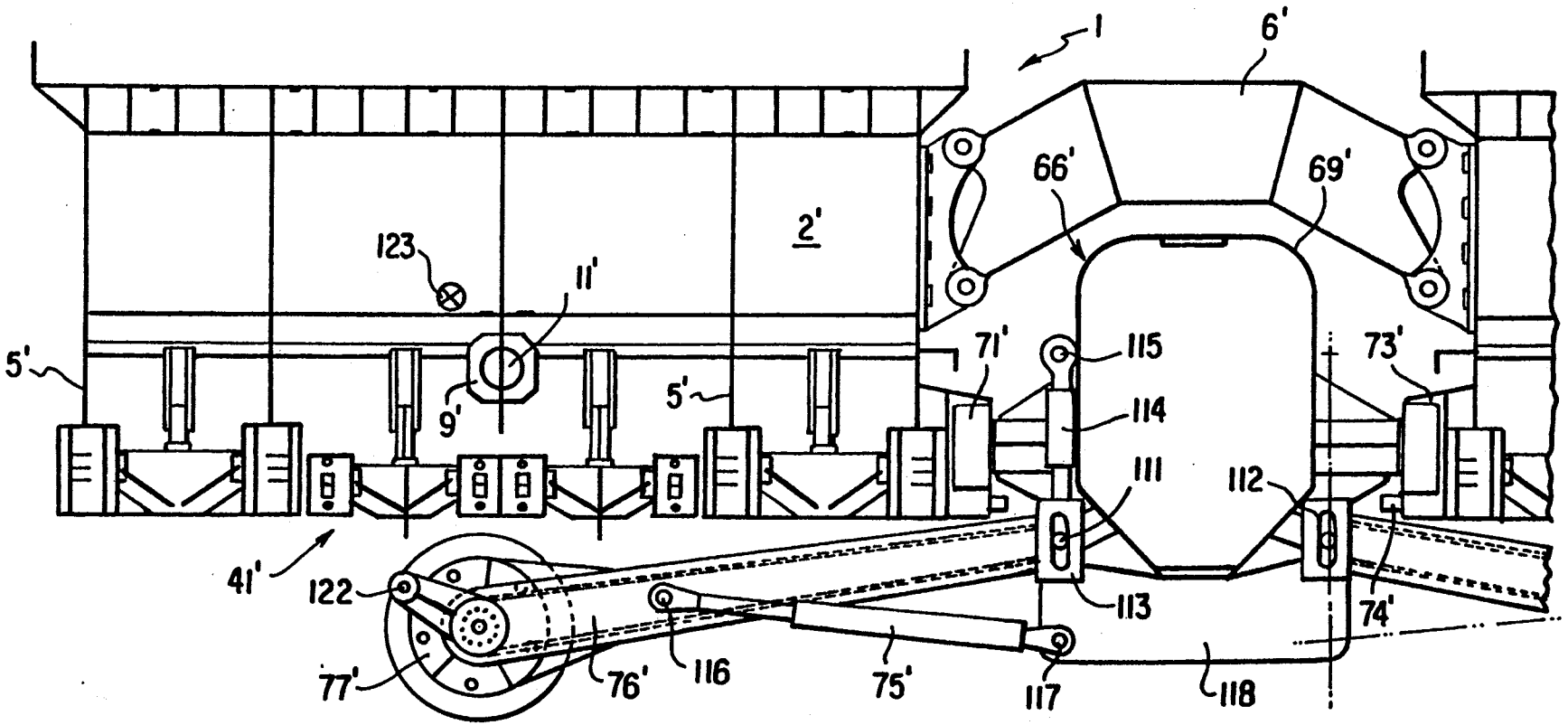
FIG. 16 is a cross-sectional view of a portion of the cantilever carrier of the laying vehicle and a bridge half.
Figure 17:
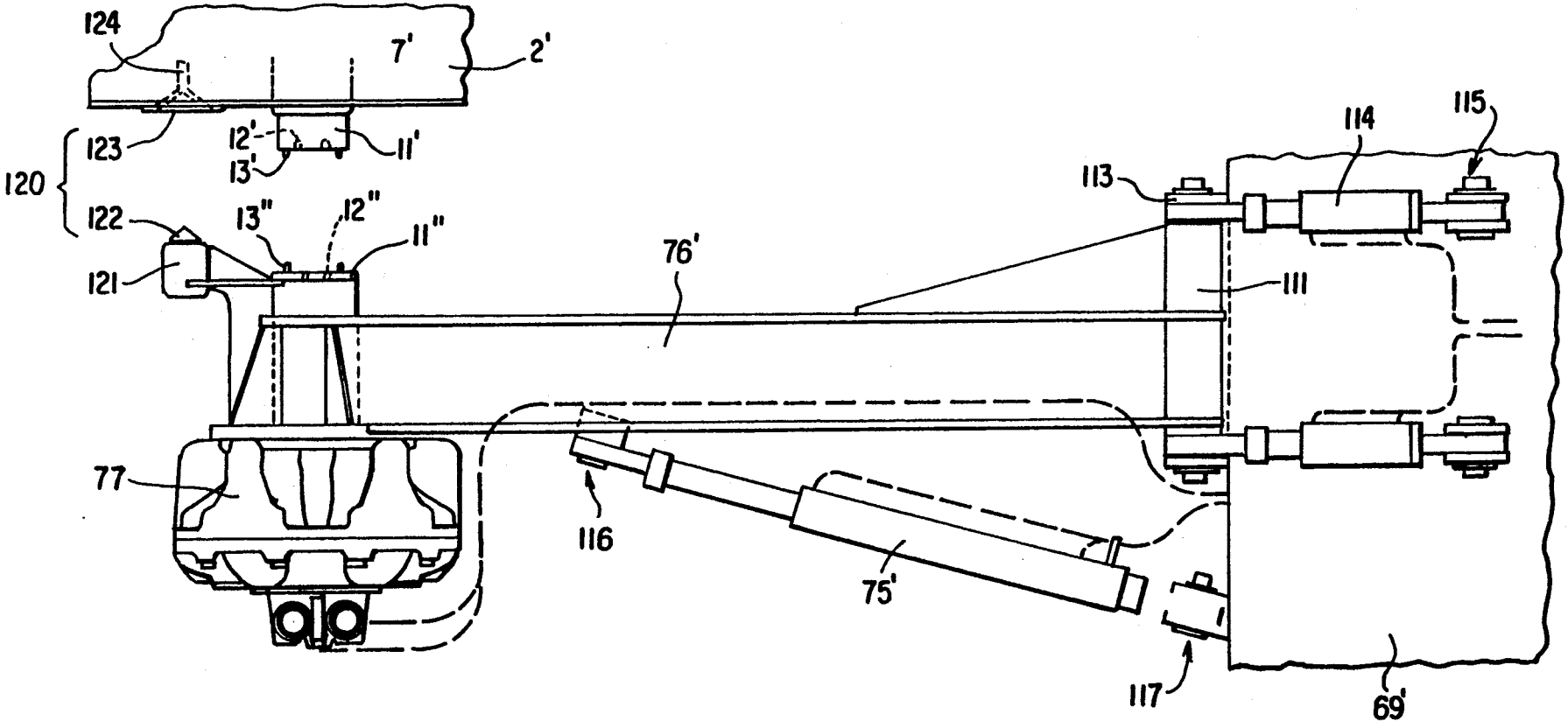
FIG. 17 is a top plan view of the pivot arm articulated to the cantilever carrier showing the rotary drive and part of the bridge section.

In the embodiment according to FIGS. 15 to 17 showing a laying vehicle 65' and a bridge 1', the pivot axis 111 of the pivot arm 76' of rotary drive 77' is vertically guided in the long hole 112 of a holder 113 that is fastened on the side at the bottom of the basic body 69' of cantilever carrier 66' and is held by two cylinders 114 whose other ends are articulated at 115 to basic body 69' (in FIG. 17, pivot arm 76' is shown in a top view and cylinders 114 are shown pivoted about 90°). Moreover, at 116 pivot arm 76' is hinged to pivot cylinder 75' whose other end is articulated at 117 to a holder 118 that is fastened to basic body 69'.

While bridge 1' is an embodiment different from that described earlier, components described in connection with bridge 1 and laying vehicle 65, which perform the same functions in bridge 1' and laying vehicle 65' (FIG. 15) are given the same reference numerals to which, however, for better differentiation, a prime symbol (') has been added.

The drive shaft arrangement disposed within bridge sections 2' is provided at each of its ends with a coupling flange 11' provided with six axially parallel coupling pins 13' and six recesses 12'. The rotary drive 77' which has a hydraulic motor 119 is also provided with a coupling flange 11'' and coupling pins 13'' as well as recesses 12'' which are provided for engagement with recesses 12' and coupling pins 13'.

At the end of pivot arm 76' where rotary drive 77' is disposed, there is arranged a component 121 of a centering device 120. Component 121 is provided with a conical pin 122. The centering device 120 additionally includes a conical indentiation or recess 123 which is disposed at the end face of the closest bridge section 2'. The center axis of pin 122 is arranged at the same distance from the rotary axis of drive 77' and the flanges or shaft end 11'', respectively, and the same angular position as the axis of recess 123 from the rotary axis of the drive shaft arrangement of the bridge and the shaft end or coupling flange 11', respectively. If pin 122 is completely engaged in recess 123, the shaft end 11'' of rotary drive 77' is automatically coupled with the coupling flange 11' of the drive shaft arrangement of bridge 1'.

In the transporting position, pivot arm 76' and rotary drive 77' rest slightly below the lowermost bridge section 2'. If pivot arm 76' is disposed outside of the longitudinal extent of the bridge, that is, drive 70 has pushed the bridge sections 2', coupled together into a bridge 1', of required bridge length sufficiently forward onto the telescopable carrier 66', pivot arm 76' is caused to be brought into the operating position, that is, into the position suitable for coupling the rotary drive 77' with the drive shaft arrangement and its shaft end or flange 11', respectively, so that pivot cylinder 75' is activated and the rotary axis of rotary drive 77' is placed approximately in a coaxial position relative to the rotary axis of the drive shaft arrangement.

To couple the rotary drive with the drive shaft arrangement of bridge 1', drive 70 moves the bridge, as described, in the direction toward pivot arm 76'. During the centering process, cylinders 75' and 114 are in the so-called "floating position" in which the cylinder chambers of the same cylinder are connected with one another without pressure. At the end of the centering process, the cylinder chambers of cylinders 75' and 114, respectively, are again disconnected from one another. Pivot arm 76' and rotary drive 77' are then held in the centered position by the hydraulic cylinders. To determine the complete penetration of pin 122 into recess 123, a sensor 124 configured, for example, as a switch may be disposed at the bottom of recess 123.

Figure 18:
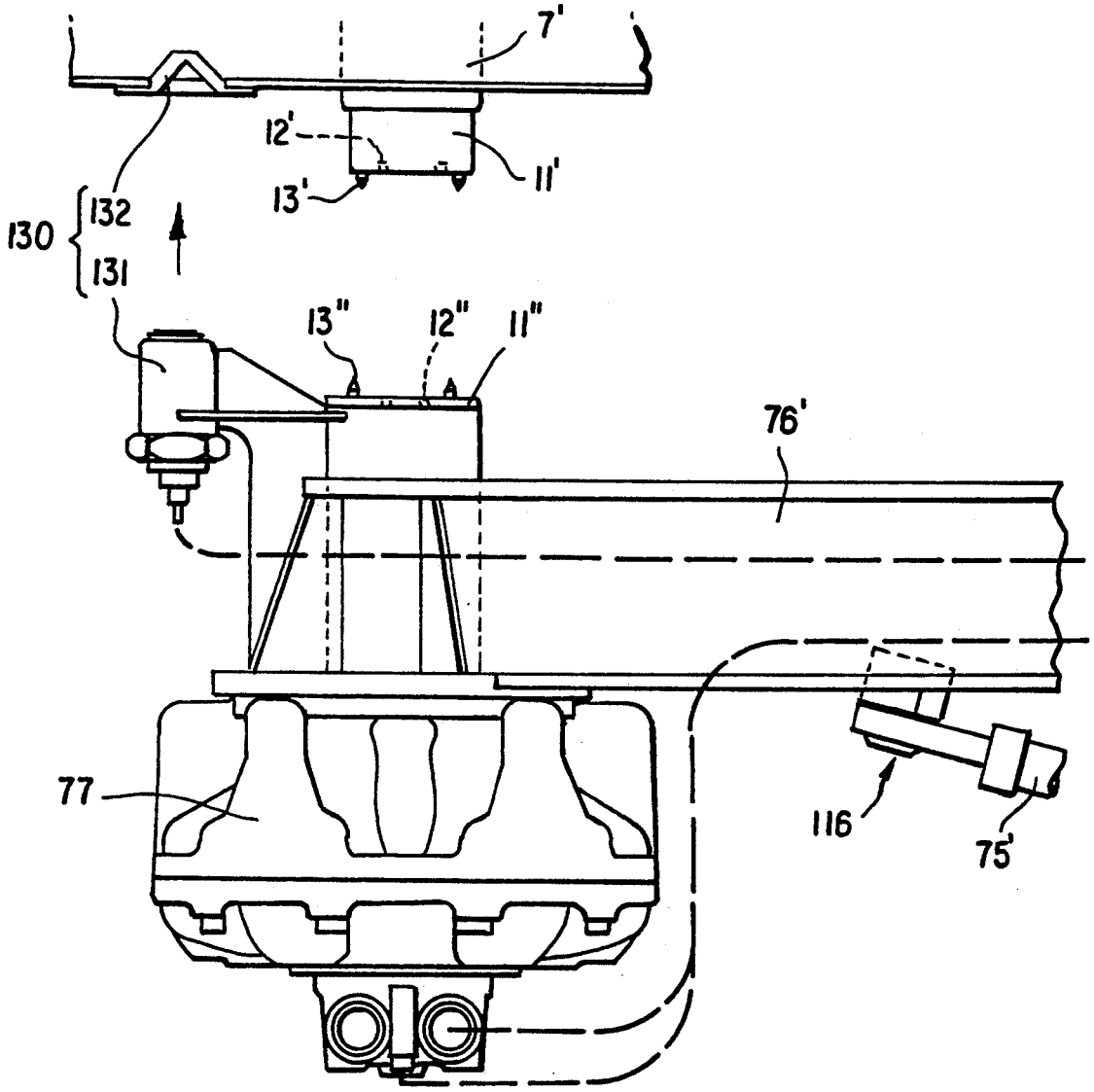
FIG. 18 depicts a contact-free centering device for steering the rotary drive onto the axis of the drive shaft arrangement.

In the embodiment according to FIG. 18, centering device 130 operates without contact. It is composed of an infrared transmitter 131 emitting a highly focused beam. The end face of the proximal bridge section is provided with a funnel-shaped recess 132. Components 131 and 132 have the same relative position to the associated axes of rotary drive 77' and the drive shaft arrangement (flange 11'), respectively, as have components 121 and 123 of the mechanical centering device 120.

When rotary drive 76' is pivoted into the operating or coupling position, the distance values measured for the surface of recess 132 are fed into a control unit installed in laying vehicle 65'. The control unit ensures that the pivot cylinder 75' and/or cylinders 114 follow up in such a manner that coaxiality is established between drive 77' and coupling flange 11'. By actuating cylinders 75' and 114 with precision, it is possible within a limited range to perform horizontal as well as vertical position changes for the axis of rotary drive 77'. In this arrangement cylinders 114 perform the function of compensating cylinders.

In an alternative embodiment, the coupling flanges 11 of the drive shaft arrangement are provided with external teeth and the pivotal rotary drive 77 has a corresponding toothed pinion.

To permit a convenient travel of vehicles on bridge end sections 2.1, 2.n, all the roadway carriers 4 are provided with integrated ramp components 80 at their ends. The ramp components 80 include a base plate 81 that extends over the entire width of a track. Below the plate 81, box girders 82 are arranged which extend in the longitudinal direction. At their rear ends, the ramp components are provided with projections 83 which prevent the ramp components 80 from sliding out of the bridge sections 2. Instead of projections 83, tension elements (not shown) may also be employed between the bridge section 2 and the ramp components 80. A metal scratch guard 84 is provided on each side of the plate 81.

The roadway carrier 4 is provided with longitudinal grooves or recesses 85, that correspond to box girders 82, in which the box girders 82 are able to slide. The ramp components can be pulled out and pushed in in a simple manner.

The bridge sections 2 are not limited to the construction shown in FIGS. 1 and 5. Instead, bridge sections 102 as shown in FIG. 8 may also be employed whose track elements include a basic bridge body 105 that has sloped end faces 106 ending at half the height of the basic bridge body. The end faces are provided with a hinge connection 107 at their ends at which a folding ramp 108, 108' is pivotally attached in such a way that it rests on the sloped face 106 or—when folded down and fixed to the basic bridge body 105 by means of a locking arrangement 109—it forms a common access ramp together with the sloped surface 106. In this embodiment, the drive shaft arrangement 7, 19, 7' which is shown in a dash-dot line, is accommodated, together with the coupling discs 11, 11' and—in the transporting position—with the bottom boom 41, which is shown in simplified form in dashed lines, in the lower half of the basic bridge body 105. In this embodiment, the coupling discs 11, 11' extend beyond the basic bridge body 105 in the uncoupled state of the bridge section 102, as shown in the right half of FIG. 8.

In a bridge constructed of only two bridge sections 2 or 102, only the pillars or pairs of pillars 23 are extended at the coupling. For such bridges it is sufficient to provide each bridge element with only one threaded spindle sleeve 21, resulting in a significant simplification of the bridge elements.

It will be understood that the above description of the present invention is susceptible to various modifications, changes and adaptations, and the same are intended to be comprehended within the meaning and range of equivalents of the appended claims.

What is claimed is:

1. In a deployable bridge, including a plurality of identical bridge sections each having two identical track elements; each track element having a roadway carrier, a bottom boom and adjustment elements connecting the bottom boom with the roadway carrier; said bottom boom being height-adjustable relative to said roadway carrier and forming a bottom tensioning assembly;

transverse supports connecting the track elements of each said bridge section with one another; and coupling means for coupling to one another the roadway carriers and the bottom booms of adjoining bridge sections;

the improvement wherein said bottom boom of each track element includes a mid section and two end sections flanking the mid section;

each track element further comprises (a) pillars having opposite first and second ends; said first end of said pillars being articulated to said mid section of said bottom boom;

(b) a drive shaft assembly suspended from the track element;

(c) spindle sleeves inserted on said drive shaft assembly;

(d) a spindle head threadedly mounted on each said spindle sleeve; said pillars being articulated by the second end thereof to a respective said spindle head;

(e) coupling elements attached to opposite ends of said drive shaft assembly; and (f) separate connecting means for torque-transmittingly connecting said spindle sleeves with said drive shaft assembly.

2. The deployable bridge as defined in claim 1, wherein the drive shaft assembly of each track element is formed of two axially aligned, consecutive drive shafts; further comprising a connecting piece torque-transmittingly and axially relatively slidably connecting said drive shafts with one another; spring means for axially urging said drive shafts away from one another and outwardly from the respective bridge section; in an uncoupled state of the bridge section said drive shafts projecting outwardly therefrom and said separate connecting means being disconnected from said spindle sleeves; further wherein upon axial motion of either one of the drive shafts against said spring means, said separate connecting means torque-transmittingly couple said one drive shaft with the spindle sleeve inserted on said one drive shaft.

3. The deployable bridge as defined in claim 1, wherein each said separate coupling means comprises a first part affixed to said drive shaft and a second part affixed to said spindle sleeve; said first and second parts being form-fittingly engageable with one another.

4. The deployable bridge as defined in claim 1, further comprising tension-loadable reinforcing elements connected to each track element and being situated between said road carrier and the ends of said mid section of said bottom boom; said bottom boom having a retracted position and an extended position; in said extended position of said bottom boom said reinforcing elements extending obliquely relative to said shaft assembly.

5. The deployable bridge as defined in claim 1, wherein said mid section of said bottom boom comprises two subsections articulated together by a link and a locking means for preventing a pivoting of said mid section away from said track element.

6. The deployable bridge as defined in claim 1, further wherein said track elements have movable ramp sections.

7. A combination of a deployable bridge as defined in claim 1 with a bridge laying vehicle, comprising (a) a telescoping cantilever arm mounted on the vehicle;

(b) a pivot arm pivotally mounted on the cantilever arm for allowing swinging motions of said pivot arm about a pivot axis;

(c) a rotary drive mounted on said pivot arm for being coupled to an adjoining end of said drive shaft assembly of one of said track elements;

(d) a main pivot power cylinder operatively connected to said pivot arm for angularly displacing said pivot arm about said pivot axis;

(e) an additional power cylinder operatively connected to said pivot arm for changing a position of said pivot axis; and (f) centering means for centering said rotary drive with said adjoining end; said centering means having a first part mounted on said rotary drive and a second part mounted on said bridge.

8. The combination as defined in claim 7, wherein said vehicle has a longitudinal axis and said pivot axis extending parallel to said longitudinal axis.

9. The combination as defined in claim 8, wherein said cantilever arm has a lower region and said pivot axis is situated below said lower region.

10. The combination as defined in claim 7, wherein one of said parts of said centering means comprises a conical pin and another of said parts comprises a conical depression.

11. The combination as defined in claim 7, wherein one of said parts of said centering means comprises a distance measuring beam transmitter and another of said parts comprises a conical depression.

12. The combination as defined in claim 7, wherein said rotary drive comprises a hydrostatic motor.

* * * * *

UNITED STATES PATENT AND TRADEMARK OFFICE

CERTIFICATE OF CORRECTION

PATENT NO. : 5,329,652

DATED : July 19, 1994

INVENTOR(S) : Hans-Norbert Wiedeck et al

It is certified that error appears in the above-indentified patent and that said Letters Patent is hereby corrected as shown below:

On the title page, item [30], the second line should read --Mar. 31, 1992 [EP] Europe.....92105517--.

Signed and Sealed this

Twenty-eight Day of February, 1995

*Attest:*

*Attesting Officer*

BRUCE LEHMAN

*Commissioner of Patents and Trademarks*